US010478667B2

(12) United States Patent
Tao

(10) Patent No.: US 10,478,667 B2
(45) Date of Patent: Nov. 19, 2019

(54) INFINITELY ADJUSTABLE TRAINING MASK WITH AN AIR FILTER AND A DRINKING DEVICE

(71) Applicant: Bo Tao, Chino, CA (US)

(72) Inventor: Bo Tao, Chino, CA (US)

(73) Assignee: Bo Tao, Chino, CA (US)

( * ) Notice: Subject to any disclaimer, the term of this patent is extended or adjusted under 35 U.S.C. 154(b) by 269 days.

(21) Appl. No.: 15/470,927

(22) Filed: Mar. 28, 2017

(65) Prior Publication Data

US 2018/0280758 A1 Oct. 4, 2018

(51) Int. Cl.

| | |
|---|---|
| ***A63B 23/18*** | (2006.01) |
| ***A63B 21/00*** | (2006.01) |
| ***A62B 18/08*** | (2006.01) |
| ***A63B 21/008*** | (2006.01) |
| ***A62B 18/02*** | (2006.01) |

(52) U.S. Cl.

CPC ..... *A63B 23/18* (2013.01); *A62B 18/086* (2013.01); *A63B 21/00058* (2013.01); *A63B 21/0085* (2013.01); *A63B 21/4003* (2015.10); *A62B 18/025* (2013.01)

(58) Field of Classification Search

CPC ..... A63B 23/18; A63B 21/00058; A63B 21/00069; A62B 18/086; A62B 18/00

See application file for complete search history.

(56) References Cited

U.S. PATENT DOCUMENTS

| | | | | |
|---|---|---|---|---|
| 3,645,261 A * | 2/1972 | West | A62B 18/086 128/201.19 |
| 4,712,594 A * | 12/1987 | Schneider | A62B 18/086 128/206.22 |
| 6,554,746 B1 * | 4/2003 | McConnell | A63B 23/18 482/13 |
| 9,579,540 B1 * | 2/2017 | Danford | A63B 21/0004 |

(Continued)

*Primary Examiner* — Kristen Matter

(57) ABSTRACT

An infinitely adjustable training mask for simulating the increased breathing resistance level at higher altitudes including an air-impermeable mask body covering the nose and mouth of the wearer, an infinitely adjustable inhalation resistance assembly extended through the mask body, a replaceable particulate air filter to provide respiratory protection when the wearer inhales, and a drinking device for hydration and consumption of foods. The inhalation resistance assembly contains a stationary aperture component and a rotating dial aperture component for adjusting the sizes of the overlapping inhalation adjustment apertures to achieve the desired breathing resistance level. Upon exhalation of the wearer, the exhaled air is discharged through a flexible one-way check valve controlled exhalation channel. A replaceable particulate air filter which can be easily placed inside or removed from the internal cavity of the infinitely adjustable inhalation resistance assembly helps to reduce inhalation exposures to airborne particles during outdoor training sessions. The drinking device enables the wearer to conveniently hydrate or consume foods without taking the mask off, thus allowing maximum amount of wear time to improve training efficiency. A strap is connected to the mask body to be positioned about the head of a wearer to securely maintain the mask during training.

2 Claims, 6 Drawing Sheets

(56) References Cited

U.S. PATENT DOCUMENTS

| | | | | |
|---|---|---|---|---|
| 2005/0121029 | A1* | 6/2005 | Reisman | A62B 17/04 128/201.22 |
| 2012/0094806 | A1* | 4/2012 | Danford | A63B 21/0004 482/13 |
| 2012/0103327 | A1* | 5/2012 | Low | A62B 18/086 128/202.15 |
| 2013/0319420 | A1* | 12/2013 | Danford | A62B 18/10 128/206.21 |
| 2016/0089553 | A1* | 3/2016 | Dickstein | A62B 18/02 128/202.27 |
| 2016/0129287 | A1* | 5/2016 | Danford | A62B 23/025 128/863 |
| 2018/0296876 | A1* | 10/2018 | Wenger | A62B 18/025 |

* cited by examiner

INFINITELY ADJUSTABLE TRAINING MASK WITH AN AIR FILTER AND A DRINKING DEVICE

DETAILED DESCRIPTION OF THE INVENTION

Field of the Invention

This invention generally relates to breathing resistance devices, such as utilized in the field of sports and exercise. More specifically, the present invention discloses a wearable ventilatory training mask with infinitely adjustable inhalation resistance valves for replicating various breathing difficulties during altitude training, a replaceable particulate air filter, and a drinking device which allows the wearer to hydrate conveniently without having to remove the mask.

BACKGROUND OF THE INVENTION

This invention pertains to a training mask capable of simulating the increased inhalation difficulty at higher altitudes and improving the wearer's physical conditioning after prolonged use. The invention allows wearers to perform interval training by adding infinitely adjustable resistance to the breathing process simultaneously.

Altitude training is the practice by some athletes of training for several weeks at high altitude. Altitude training works because of the difference in atmospheric pressure between sea level and high altitude. At sea level, air is denser and there are more molecules of gas per liter of air. Regardless of altitude, air is composed of 21% oxygen and 78% nitrogen. As the altitude increases, the pressure exerted by these gases decreases, making it more difficult to breathe as more effort is required for the breathing musculatures to achieve the needed oxygen intake, this causes a variety of physiological changes in the body that occur at high altitude, and some of these physiological adaptations are responsible for performance gains achieved from altitude training. The performance gains that altitude training may have on the body include increased endurance, reduced recovery time, weight loss, increase in HGH (Human Growth Hormones) and red blood cells.

Therefore, it is desirable to provide a device that will simulate high altitude conditions such that a wearer can experience increased breathing difficulty levels during interval trainings. By using the device, pulling air into the lungs becomes more difficult requiring deeper and more forceful breathing, which trains the respiratory muscles from the diaphragm to the intercostals, allowing the athlete to target a critical performance area. Although devices for simulating higher altitude conditions have been patented and marketed, it is desirable to have an economical device which can be easily worn by a wearer and allow for seamless simultaneously breathing difficulty adjustments, and the ability to consume foods or beverages conveniently, while the wearer engages in various physical activities such as weight training and aerobic exercises.

There are several respiratory training apparatuses available in the marketplace today. Their core designs range from blow tubes and fibrous filter-based air channels, to air admittance valves. However, these options are considered to be inconvenient and cumbersome to use in one way or another. These designs have all or some of the following drawbacks:

1. Unable to infinitely and seamlessly adjust to wearer's gradually changing physical conditioning due to having preset resistance level mechanisms;
2. Adjusting the breathing resistance level is too difficult and involves a learning curve and changing/adjusting multiple parts;
3. Requiring the wearer to frequently remove the apparatus if and when hydration is needed. Ideally, a good respiratory training apparatus should be able to seamlessly adapt to the wearer's conditioning simultaneously without involving complicated operations, and allow convenient and proper amount of hydration without removal or breaking a training session.

Illustrative of respiratory training apparatus include U.S. Pat. Nos. 9,067,086 B2, 5,848,589 A, 6,554,746B1, 4,973,047, 4,221,381 and 4,739,987.

U.S. Pat. No. 9,067,086 B2 discloses a wearable training mask providing varied presets of inhalation resistance settings by incorporating air admittance valve subassemblies into the mask body. U.S. Pat. No. 5,848,589 A discloses a training mask with a valve-controlled air channel including a plurality of fibrous filters releasably engaged within which reduce the oxygen density as ambient air draw through the air channel, replicating the decrease in oxygen at higher altitudes and requiring the wearer to increase the breathing effort; the exhaled air is discharged through a valve controlled exhaust ports upon exhalation. U.S. Pat. No. 6,554,746B1 discloses an inspiratory training device including an inhale/exhale chamber with an opening, an inlet connected to the chamber, a one-way exhaust valve for the discharge of exhaled air, and another valve capable of varying the degree of resistance depending upon the volume of air that has passed through the inlet into the chamber. U.S. Pat. No. 4,973,047 discloses a device for exercising and stimulating the lung including a mouthpiece for exhalation connected to a cylindrical hollow tube with openings, and the tube communicates with the surrounding atmosphere through an adjustable cap serving as a valve by covering its openings, this enables the device to be adjustable to preset exhalation resistance levels. U.S. Pat. No. 4,221,381 discloses a respiratory exerciser which includes a hollow tubular body having multiple openings and an adjustment structure with size indicators at one end of the tube, a mouthpiece removably connected to the other end, and a piston is reciprocally slidable in the tube such that when the wearer inhales and exhales the piston will reciprocate accordingly. The adjustment structure regulates the size of the tubular body's openings to achieve various preset breathing resistance levels. U.S. Pat. No. 4,739,987 discloses a respiratory exerciser having a hollow body with three openings. The top opening is for the wearer to breathe, while the other two side openings regulate the inhalation and exhalation resistance by using apertures and two rotatable caps with aperture holes. By rotating the caps with aperture holes and align with the apertures on the side openings, preset breathing resistance levels can be achieved.

In comparison, the training mask described herein has an infinitely adjustable inhalation resistance assembly extended through the mask body which allows seamless inhalation resistance adjustments, a flexible one-way check valve controlled exhalation channel, a replaceable particulate air filter, and a drinking device for hydration and consumption of foods without inconveniencing the wearer to remove the mask. None of the existing patents or marketed products today has addressed the above needs, which are the core focuses of the invention.

SUMMARY OF THE INVENTION

A basic object of the present invention is to improve a respiratory training mask of the type mentioned in terms of the infinite breathing resistance adjustment, the replaceable particulate air filter, and the convenient handling of the drinking during exercise.

The present invention discloses a respiratory training mask incorporating an infinitely adjustable inhalation resistance assembly extended through a mask body to simulate the gradually increasing breathing difficulties at higher altitudes, this in turn improves the wearer's breathing musculature and physical conditioning through interval training. The infinite adjustment of the inhalation resistance assembly is achieved by rotating a dial that precisely controls the sizes of the overlapping inhalation adjustment apertures on the assembly to affect a speed of air flow into said mask body during inhalation by the wearer. The training mask exhibits a face-conforming air impermeable mask body that defines a mask interior space and perimeter seal and enclosing the wearer's nose and mouth.

A replaceable particulate air filter is incorporated into the internal space of said inhalation resistance assembly inside the mask body, which helps to reduce inhalation exposures to airborne particles during outdoor training sessions. This enables the wearer to exercise in case of polluted areas and reduce the possibility of allergies. The replaceable particulate air filter can be easily removed from said inhalation resistance assembly or replaced via a sliding motion when not needed or expired.

At least one flexible one-way check valve controlled exhalation channel is incorporated into said inhalation resistance assembly or along said mask body. The one-way valve has a flexible diaphragm configured to close during inhalation and open during exhalation by the wearer. The flexible diaphragm has a thin and substantially planar disc portion exhibiting an outline covering the outer perimeter of said exhalation channel. A mounting rod extends from the center of said planar disc portion is attached to the center of the planar portion of the exhalation channel.

According to the invention, a mask body is provided with a rotatable connection piece and an external drinking tube for the consumption of food or beverages. The drinking tube forms a pathway with a bendable internal mouthpiece within the mask, sealed by an adapter on a second connection piece extending through the mask body, or alternatively, an airtight cap at the external distal end that seals the external drinking tube from ambient air during exercise.

A rotatable connection piece, which changes the orientation of the external drinking tube in relation to the liquid container, is provided according to the present invention between the bendable internal mouthpiece and the external drinking tube. The main body of the connection piece is shaped like a turning knob, allowing it to be rotated easily to perform the adjustment of the bendable internal mouthpiece and the external drinking tube. The external drinking tube is made of flexible corrugated tubing and can be pivoted freely into the desired position towards the liquid container. The bendable internal mouthpiece is made of a memory tube which can be bent or rotated into any position to fit the wearer's mouth and facial structure.

Alternatively, according to the invention, a mask body is provided with an inlet port with an airtight cap for the consumption of food or beverages; the inlet chamber extends through the mask body. The airtight cap remains closed during exercise, and opens to allow the wearer to consume food or beverages conveniently without requiring the removal of the training mask from the wearer's face.

An external elastic strap or harness extending from said mask body is provided for comfortably placing and holding the mask in proper position upon the wearer's face for hands free operation. The strap may consist of a harness placed around the back of the wearer's head and elastic members with quick inter-engaging detachable fasteners for easy affixing and removal.

The various features of the invention are indicated in the claims annexed to and forming a part of this disclosure. For a clear understanding of the invention, its advantages and specific objects accomplished by its uses, reference is made to the accompanying drawings and descriptive matter in which preferred embodiments of the invention are illustrated. An exemplary embodiment of the device according to the present invention is shown in the drawings, and will be explained in more detail below.

DETAILED DESCRIPTION OF THE PREFERRED EMBODIMENTS

Figure 2:
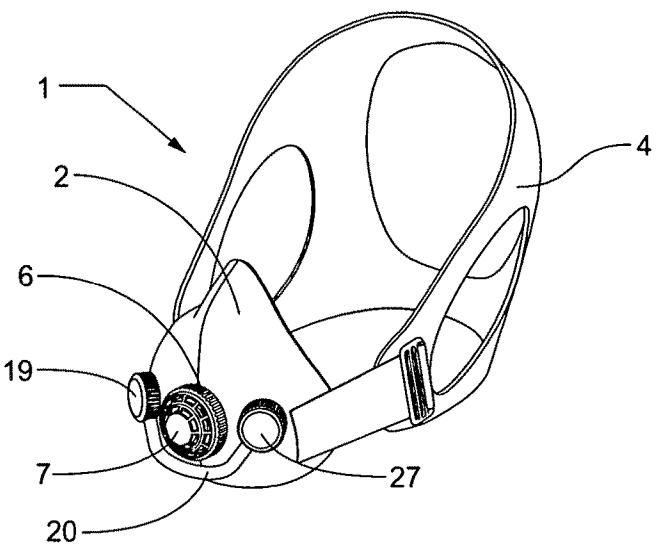
FIG. 2 is a detached perspective view of the training mask according to FIG. 1.
Figure 1:
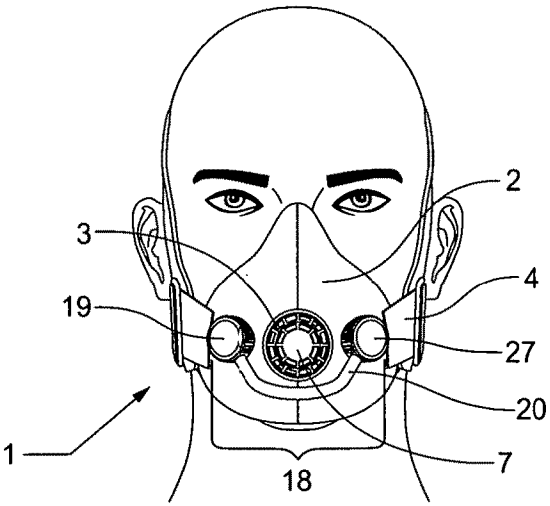
FIG. 1 is an operational front view showing the training mask according to the invention being worn by a wearer.
Figure 16:
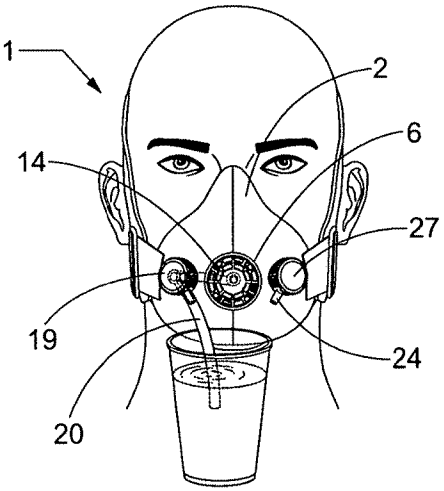
FIG. 16 is a front view of the training mask according to FIG. 1 where the wearer is drinking water from a cup through a drinking device.
Figure 15:
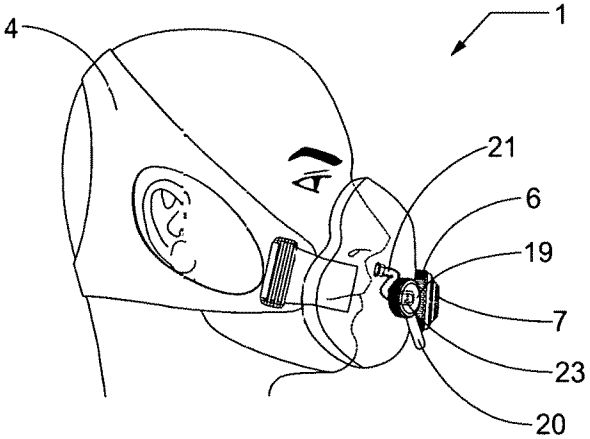
FIG. 15 is a side view of the training mask according to FIG. 1.

Referring to the drawings in particular, FIGS. 1-2 and FIG. 15 show in a front view, a perspective view, and a side view of a training mask 1 with an infinitely adjustable inhalation resistance assembly 3 extending through a mask body 2, with a drinking device 18 on a rotatable connection piece 19. The mask body 2 has an elastic head harness strap assembly 4 to allow hands-free use of the training mask 1. The drinking device 18 has, on the outside of the mask body 2, an external drinking tube 20 which can be brought into connection with a reservoir for liquid or food, the external drinking tube is connected to a rotatable connection piece 19 extending through the mask body 2, and on the interior space of the mask body 2, an internal mouthpiece 21 which can be adjusted to fit a wearer's mouth and facial structure, as shown in FIG. 16. An airtight drinking tube adapter 24, into which the external drinking tube 20 can be plugged in a parked and airtight position when not in use, is provided on the opposite side of the rotatable connection piece 19.

Figure 3:
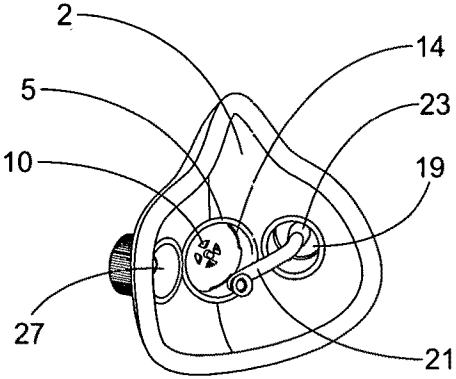
FIG. 3 is a rotated rear perspective view of the training mask according to FIG. 2 and illustrating the first stationary internal component without the replaceable particulate air filter.

FIG. 3 illustrates an inner view of the training mask 1 according to FIG. 1. Identical components are designated by the same reference numbers as in FIG. 1 and FIG. 2. The drinking device 18 has, on the inside of the mask, a bendable internal mouthpiece 21, through which the wearer can consume liquid or food.

Figure 4:
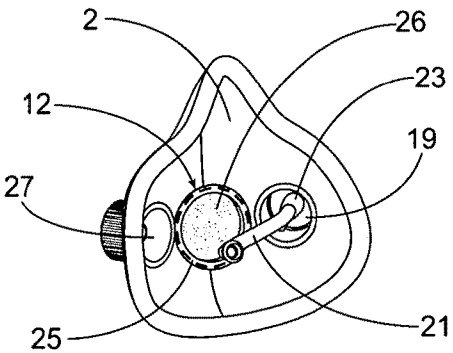
FIG. 4 is a rotated rear perspective view of the training mask according to FIG. 2 and illustrating the first stationary internal component with the replaceable particulate air filter.
Figure 5:
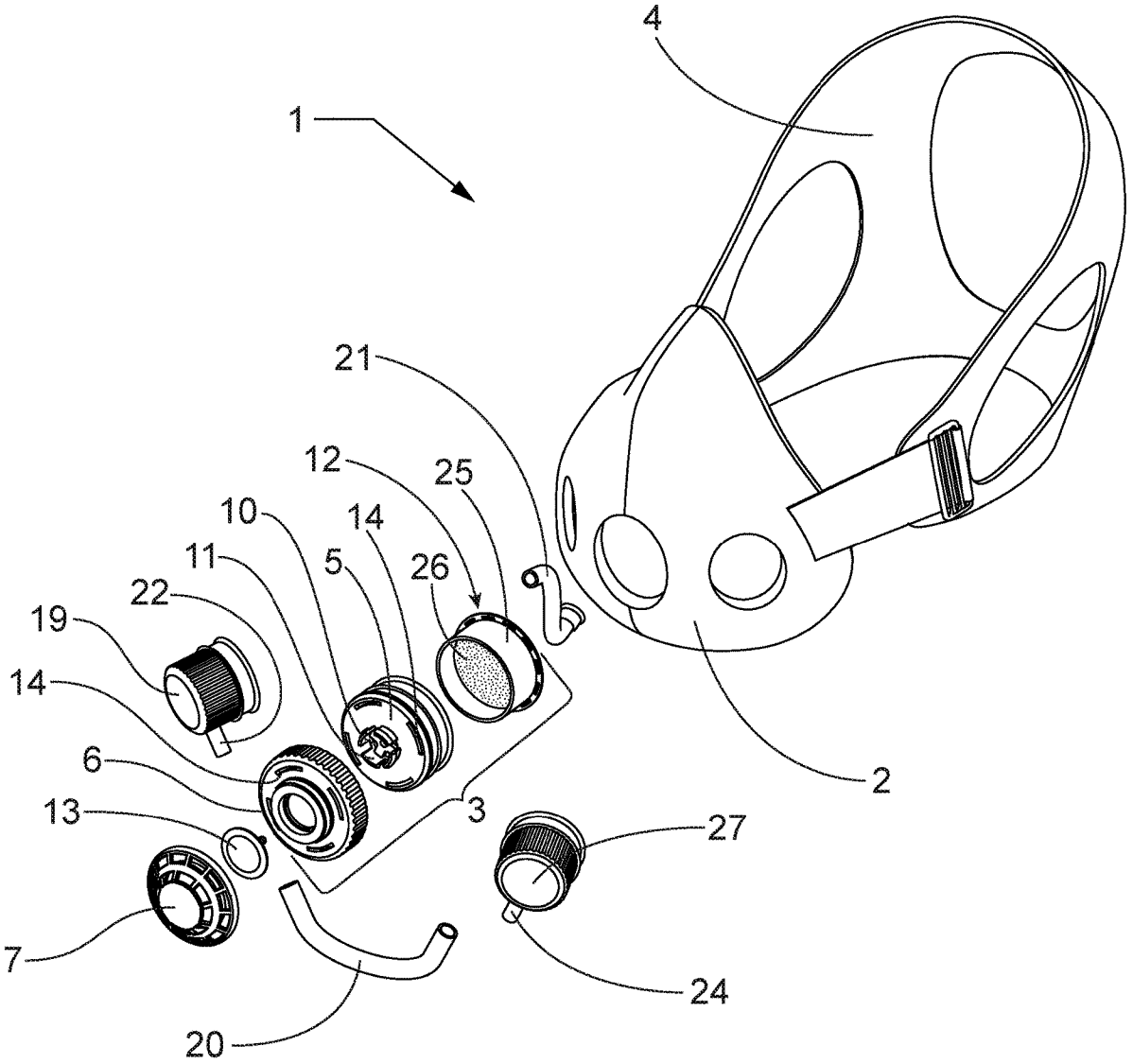
FIG. 5 is an exploded view of the training mask, the infinitely adjustable inhalation resistance sub-assemblies, the replaceable particulate air filter, and the drinking device sub-assemblies; the inhalation resistance assembly allows for infinitely customizable inhalation resistance levels in order to seamlessly simulate the breathing difficulties associated with gradual changes in altitude elevations, while the drinking allows for the consumption of liquid or food conveniently without requiring the wearer to remove the training mask.

FIG. 4 shows an inner view of the training mask 1 according to FIG. 1. A replaceable particulate air filter 12 is placed inside the internal cavity of the infinitely adjustable inhalation resistance assembly 3;

FIG. 5 shows an exploded view of the training mask 1 according to FIG. 1. The infinitely adjustable inhalation resistance assembly 3 comprises a first stationary internal component 5 with air permitting exhalation apertures 10 and overlapping inhalation adjustment apertures 14, a second external rotating dial 6 with air exhalation channel 11 and overlapping inhalation adjustment apertures 14, a flexible one-way check valve 13, a replaceable particulate air filter 12 comprising a cylindrical mounting frame 25 and air filter element 26, the replaceable particulate air filter can be easily placed inside or removed from the internal cavity of the first stationary internal component 5, and a large protective cap 7. The drinking device 3 comprises of an external drinking tube 20 connected via a tube fitting 22 to a rotatable connection piece 19 extending through the mask body 2, the external drinking tube 20 can be placed in a parked position by plugging the distal end onto an airtight drinking tube adapter 24, an bendable internal mouthpiece 21 is connected via a mouthpiece fitting 23 to the rotatable connection piece 19 which allows the wearer to easily consume food or liquid through an unplugged external drinking tube 20.

Figure 8:
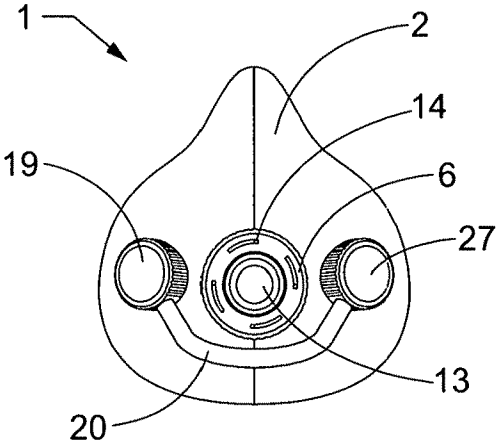
FIG. 8 is a succeeding view to FIG. 7 and the infinitely adjustable inhalation resistance assembly adjusted to 87.5% inhalation resistance by rotating the second external rotating dial.
Figure 7:
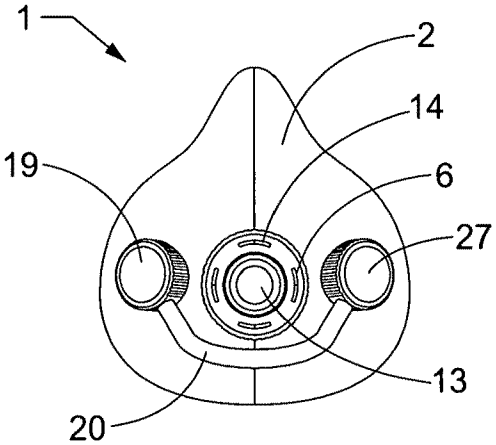
FIG. 7 is a succeeding view to FIG. 6 and the infinitely adjustable inhalation resistance assembly adjusted to 50% inhalation resistance by rotating the second external rotating dial.
Figure 6:
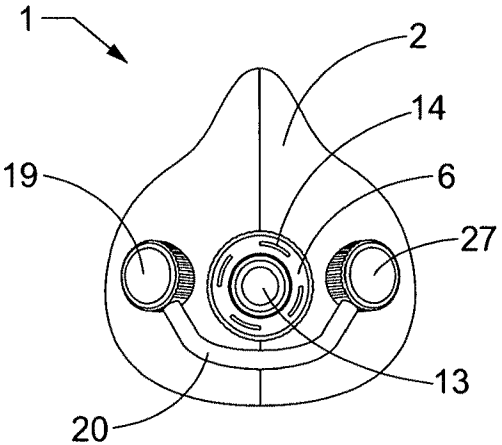
FIG. 6 is a front view of the training mask according to FIG. 2 and the infinitely adjustable inhalation resistance assembly adjusted to 0% inhalation resistance by rotating the second external rotating dial.

FIG. 6-8 show in a front view of the training mask 1 according to FIG. 2 with the protective cap 7 removed to better illustrate the seamless rotary adjustments of the infinitely adjustable inhalation resistance assembly 3. An infinite amount of inhalation resistance adjustments can be achieved by turning the second external rotating dial 6, this brings the corresponding overlapping inhalation adjustment apertures 14 on the first stationary internal component 5 and the second external rotating dial 6 into and out of alignment circularly to gradually increase or decrease the size of the inhalation apertures. The inhalation resistance levels of 0%, 50%, and 87.5% are shown in FIG. 6-8.

Figure 9:
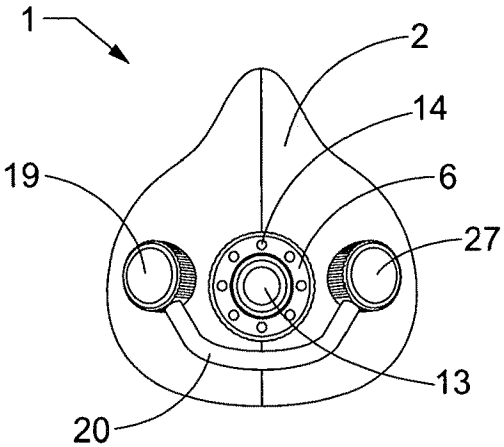
FIG. 9 is a front view of the training mask according to FIG. 2 and the infinitely adjustable inhalation resistance assembly with alternatively shaped (circular) overlapping inhalation adjustment apertures.
Figure 10:
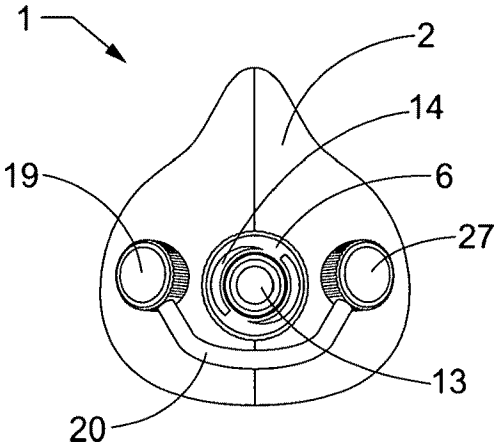
FIG. 10 is a front view of the training mask according to FIG. 2 and the infinitely adjustable inhalation resistance assembly with another alternatively shaped (crescent) overlapping inhalation adjustment apertures.

FIG. 9-10 show in a front view of the training mask 1 according to FIG. 2, and the shapes of the overlapping inhalation adjustment apertures 14 on the first stationary internal component 5 and the second external rotating dial 6 are illustrated differently to show the other possible shapes of the apertures.

Figure 11:
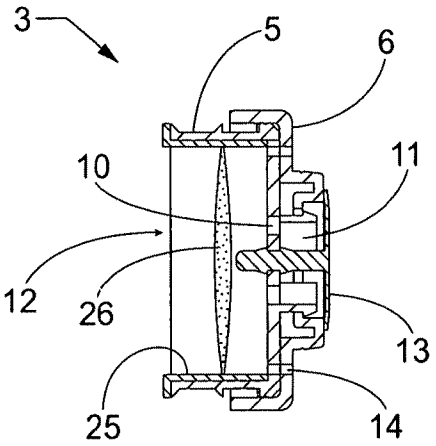
FIG. 11 is a sectional view of the infinitely adjustable inhalation resistance assembly and the flexible one-way check valve in an closed position blocking air from entering the air exhalation channel during inhalation.

FIG. 11 shows a sectional view of the infinitely adjustable inhalation resistance assembly 3 with a replaceable particulate air filter 12 and a flexible one-way check valve 13 in a closed position during inhalation of a wearer and blocking air from entering the air exhalation channel 11, the replaceable particulate air filter 12 ensures that only filtered clean air passes through the mask body 2 and inhaled by the wearer, thus helping to reduce inhalation exposures to airborne particles during outdoor training sessions.

Figure 12:
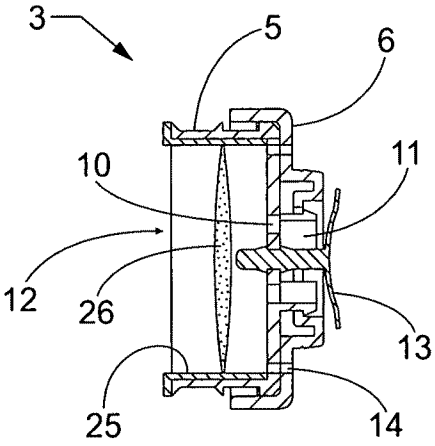
FIG. 12 is a succeeding view to FIG. 9 and depicts the flexible one-way check valve in an open position allowing air to exit from the air exhalation channel during exhalation.

FIG. 12 shows a sectional view of the infinitely adjustable inhalation resistance assembly 3 with a replaceable particulate air filter 12 comprising a cylindrical mounting frame 25 and air filter element 26, and a flexible one-way check valve 13 in an open position during exhalation of a wearer and permitting exhaled air to escape from the interior space of the mask body 2 through the air exhalation channel 11 to ambient space.

Figure 13:
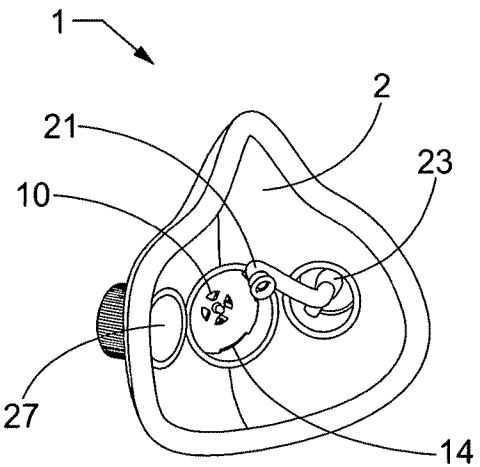
FIG. 13 is a rotated rear perspective view of the training mask according to FIG. 2 and the bendable internal mouthpiece adjusted to a higher position to fit a wearer's mouth and facial structure.
Figure 14:
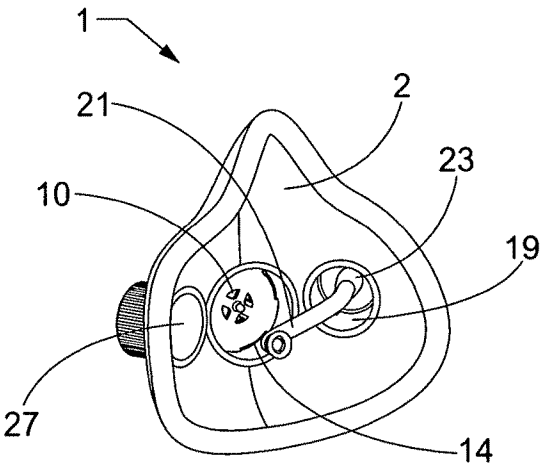
FIG. 14 is a succeeding view to FIG. 11 and the bendable internal mouthpiece adjusted to a lower position to fit a wearer's mouth and facial structure.

FIG. 13-14 show in a rear perspective view of the training mask 1 according to FIG. 2. By actuating the rotatable connection piece 19 or directly adjusting the bendable internal mouthpiece 21, the position of the mouthpiece 21 within the mask body 2 can be changed to accommodate different wearers' individual mouth and facial structure.

FIG. 16 illustrates a front view of the training mask 1 according to FIG. 1. The external drinking tube 20 is detached from the airtight drinking tube adapter 24, and the rotatable connection piece 19 is actuated to pivot the external drinking tube 20 to a lower position and submerged in a liquid contained in a drink cup, the internal mouthpiece 21 is adjusted to match the position of the wearer's mouth to allow the consumption of liquid from the drinking cup through the drinking device 18.

Figure 17:
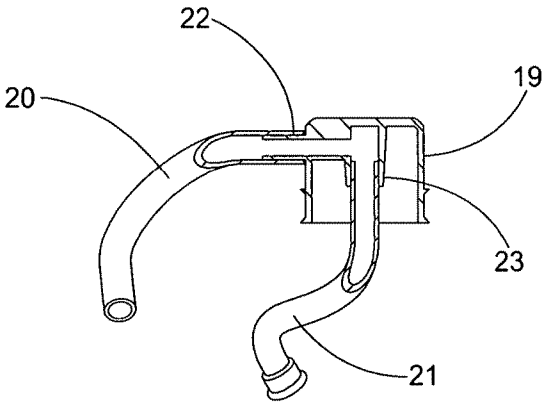
FIG. 17 is a sectional view of a drinking device.

FIG. 17 shows a sectional view of a drinking device 18 according to FIG. 2. The drinking device 18 comprises a rotatable connection piece 19 which extends through the mask body 2 and is accommodated in a rotatably movable manner, an external drinking tube 20 attached to a tube fitting 22 on the rotatable connection piece 19, and an internal mouthpiece 21 attached to a mouthpiece fitting 23 on the rotatable connection piece 19 in a rotatably movable and bendable manner for consuming liquid or food, an unobstructed and sealed pathway for the consumption of liquid or food is formed by the external drinking tube 20, the tube fitting 22, the rotatable connection piece 19, the mouthpiece fitting 23, and an internal mouthpiece 21.

Figure 19:
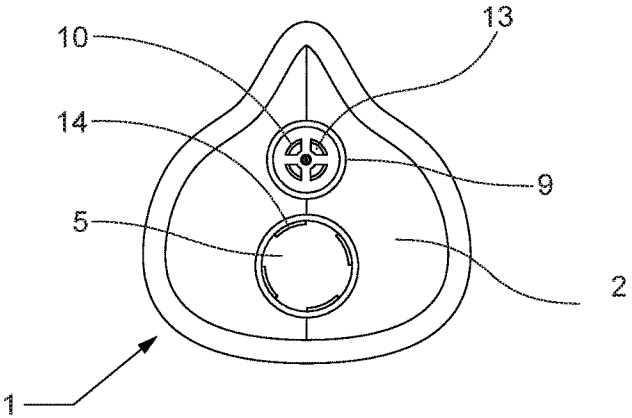
FIG. 19 is a rear view of a training mask according to FIG. 18.
Figure 18:
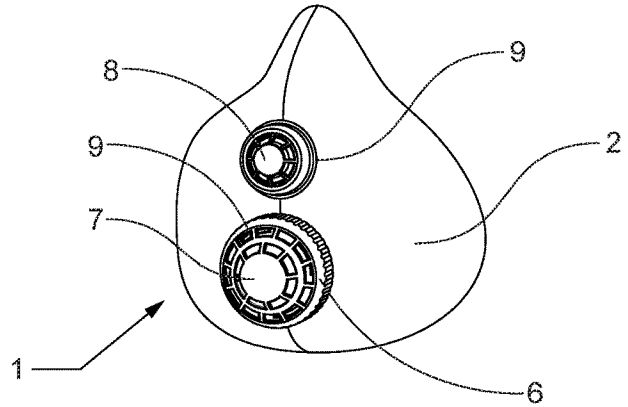
FIG. 18 is a perspective view of a training mask with an infinitely adjustable inhalation resistance assembly and a separate air exhalation assembly.
Figure 20:
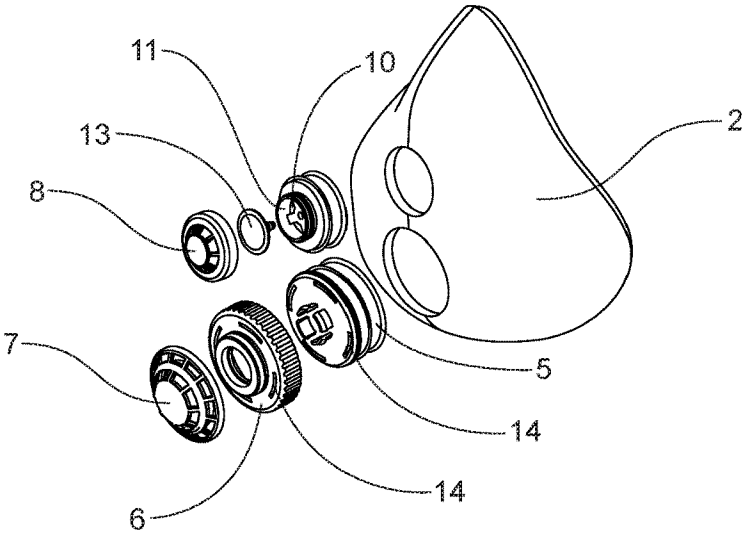
FIG. 20 is an exploded view of a training mask according to FIG. 18.

FIG. 18-20 show in a perspective view, rear view, and an exploded view of a training mask 1. The infinitely adjustable inhalation resistance assembly 3 and the air exhalation channel assembly 9 are separate to demonstrate other possible configurations of the invention.

Figure 21:
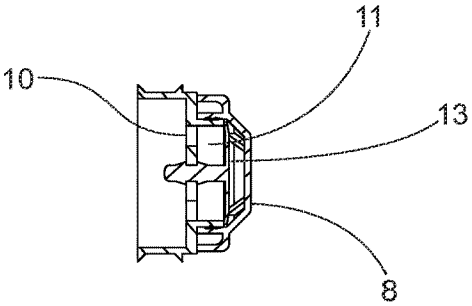
FIG. 21 is a sectional view of an air exhalation channel assembly on a training mask according to FIG. 18.

FIG. 21 shows a sectional view of an air exhalation channel assembly 9 on a training mask 1 according to FIG. 18. A flexible one-way check valve 13 can be in a closed position during inhalation of a wearer and blocking air from entering the air exhalation channel 11, or in an open position to permit exhaled air to escape from the interior space of the mask body 2 through the air exhalation channel 11 to ambient space during exhalation of a wearer.

Figure 22:
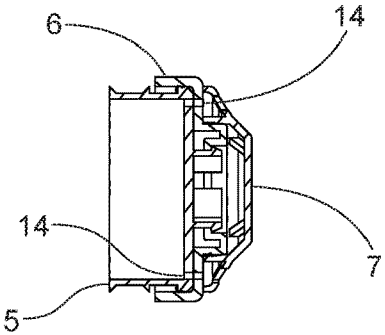
FIG. 22 is a sectional view of an infinitely adjustable inhalation resistance assembly on a training mask according to FIG. 18.

FIG. 22 shows a sectional view of an infinitely adjustable inhalation resistance assembly 3 on a training mask 1 according to FIG. 18. An infinite amount of seamless inhalation resistance adjustments can be achieved by turning the second external rotating dial 6, this brings the corresponding overlapping inhalation adjustment apertures 14 on the first stationary internal component 5 and the second external rotating dial 6 into and out of alignment circularly to gradually increase or decrease the size of the inhalation.

While specific embodiments of the invention have been shown and described in detail to illustrate the application of the principles of the invention, it will be understood that the invention may be embodied otherwise without departing from such principles.

APPENDIX LIST OF REFERENCE NUMBERS

1. Training mask
2. Mask body
3. Infinitely adjustable inhalation resistance assembly
4. Elastic head harness strap assembly
5. First stationary internal component
6. Second external rotating dial
7. Large protective cap
8. Small protective cap
9. Air exhalation channel assembly
10. Air permitting exhalation apertures
11. Air exhalation channel
12. Replaceable particulate air filter
13. Flexible one-way check valve
14. Overlapping inhalation adjustment apertures
18. Drinking device
19. Rotatable connection piece
20. External drinking tube
21. Bendable internal mouthpiece
22. Tube fitting
23. Mouthpiece fitting
24. Airtight drinking tube adapter
25. Cylindrical mounting frame
26. Air filter element
27. Second rotatable connection piece

What is claimed is:

1. A training mask comprising:

an air impermeable mask body defining a mask interior space and perimeter seal, wherein said perimeter seal and said interior space are configured to enclose a wearer's nose and mouth;

at least one adjustable inhalation resistance assembly extending through said mask body, said at least one adjustable inhalation resistance assembly comprising a first stationary internal component and a second external rotating dial parallelly and co-radially stacked on top of said first stationary internal component such that turning said second external rotating dial adjust sizes of corresponding overlapping inhalation adjustment apertures formed by said first stationary internal component and second external rotating dial to control inhalation resistance of ambient air through said overlapping inhalation adjustment apertures into said mask interior space in response to inhalation by the wearer;

an air exhalation channel subassembly comprising:

air permitting exhalation apertures located at a center of a top planar portion of said first stationary internal component;

an air exhalation channel located at a center of a top planar portion of said second external rotating dial; and a flexible one-way check valve for regulating a discharge of exhaled air of the wearer; and an integrally-disposed replaceable particulate air filter incorporated into said first stationary internal component for filtering inhaled air that passes through said mask body;

wherein the replaceable particulate air filter comprises a cylindrical mounting frame adapted to closely fit inside and extend through an internal chamber of said first stationary internal component and an air filter element adapted to be positioned in said cylindrical mounting frame and cover an entire area defined by an inner diameter and perimeter of the internal chamber of said first stationary internal component to ensure that only filtered clean air passes through said mask body during, inhalation by a wearer.

2. A training mask comprising:

an air impermeable mask body defining a mask interior space and perimeter seal, wherein said perimeter seal and said interior space are configured to enclose a wearer's nose and mouth;

at least one adjustable inhalation resistance assembly extending through said mask body, said at least one adjustable inhalation resistance assembly comprising a first stationary internal component and a second external rotating dial parallelly and co-radially stacked on top of said first stationary internal component such that turning said second external rotating dial adjusts sizes of corresponding overlapping inhalation adjustment apertures formed by said first stationary internal component and second external rotating dial to control inhalation resistance of ambient air through said overlapping inhalation adjustment apertures into said mask interior space in response to inhalation by the wearer;

an air exhalation channel subassembly comprising:

air permitting exhalation apertures located at a center of a top planar portion of said first stationary internal component;

an air exhalation channel located at a center of a top planar portion of said second external rotating dial; and a flexible one-way check valve for regulating a discharge of exhaled air of the wearer;

an external drinking tube located outside said mask body;

a rotatable connection piece extending through said mask body;

a bendable internal mouthpiece located inside said mask body for the consumption of liquid or food by the wearer; and a second connection piece adjacent to said at least one adjustable inhalation resistance assembly on an opposite side thereof from said rotatable connection piece, said second connection piece extending through said mask body, said second connection piece further having an airtight drinking tube adapter into which an external distal end of said external drinking tube is configured to be plugged in a parked position during exercise.

* * * * *